US007488066B2

(12) United States Patent
Nakashima

(10) Patent No.: US 7,488,066 B2
(45) Date of Patent: Feb. 10, 2009

(54) INK JET PRINTER

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 493 days.

(21) Appl. No.: 11/234,283

(22) Filed: Sep. 26, 2005

(65) Prior Publication Data

US 2006/0066706 A1 Mar. 30, 2006

(30) Foreign Application Priority Data

Sep. 30, 2004 (JP) ..... 2004-288254

(51) Int. Cl.
*B41J 2/01* (2006.01)

(52) U.S. Cl. ..... 347/104; 347/35; 347/36; 347/101; 347/107

(58) Field of Classification Search ..... 347/31, 347/36, 104; 400/23, 629, 648, 656
See application file for complete search history.

(56) References Cited

U.S. PATENT DOCUMENTS 6,168,259 B1 * 1/2001 Capurso ..... 347/36
6,457,803 B1 * 10/2002 Ohkoda ..... 347/36
6,672,705 B2 1/2004 Kitahara et al.
7,021,756 B2 * 4/2006 Nakashima et al. ..... 347/104
2003/0128253 A1 * 7/2003 Kitahara et al. ..... 347/42
2004/0100544 A1 5/2004 Okamoto et al.
2004/0263603 A1 * 12/2004 Maki et al. ..... 347/104
2005/0088503 A1 * 4/2005 Kojima ..... 347/101
2005/0093919 A1 * 5/2005 Takatsuka et al. ..... 347/30

FOREIGN PATENT DOCUMENTS

JP 4016438 1/1992
JP 2000272110 10/2000

* cited by examiner

*Primary Examiner*—Luu Matthew
*Assistant Examiner*—John P Zimmermann
(74) *Attorney, Agent, or Firm*—Banner & Witcoff, Ltd.

(57) ABSTRACT

Rollers between which an endless belt is wound have a pair of first grooves looping around a rotational axis of each roller. A pair of second grooves is formed in an upper face of a support plate that supports an inner face of the endless belt, these second grooves extending along an entire length of the support plate in a feeding direction of the printing sheet. Each of the first grooves and the second grooves are disposed so as to be in the same straight line. First ink absorbers are provided that absorb ink within the first grooves. Second ink absorbers are provided that absorb ink within the second grooves. Protruding rails are formed on the inner face of the endless belt and fit into the first grooves and the second grooves. These first and second grooves prevent feeding accuracy of printing sheets from deteriorating.

20 Claims, 8 Drawing Sheets

INK JET PRINTER

CROSS-REFERENCE TO RELATED APPLICATION

This application claims priority to Japanese Patent Application No. 2004-288254, filed on Sep. 30, 2004, the contents of which are hereby incorporated by reference into the present application.

BACKGROUND OF THE INVENTION

1. Field of the Invention

The present invention relates to an ink jet printer that prints a desired image (this including writing) on a printing sheet by discharging ink towards the printing sheet. In particular, the present invention relates to an ink jet printer in which a mechanism has been improved that rotates an endless belt used for feeding the printing sheet.

2. Description of the Related Art

An ink jet printer discharges ink from nozzles formed in a printing head. The ink that has been discharged is deposited on a printing sheet at a printing position, thus printing a desired image on the printing sheet. In order to feed the printing sheet to the printing position, the ink jet printer is provided with a pair of rollers and an endless belt wound across the pair of rollers. A support plate is frequently used that supports the endless belt at a location between the pair of rollers. The support plate supports an inner face of the endless belt from bellow. The support plate prevents the endless belt from bending downwards.

In this ink jet printer, when no ink is discharged from the nozzles for a long period, a surface of the ink within the nozzles may dry out, causing deterioration in ink discharge. In order to prevent this occurring, a flushing action is periodically executed, i.e. ink is forcibly discharged from the nozzles towards a location other than the printing sheet.

Ink jet printers come in both the serial type and the line type. With serial type ink jet printers, the printing head moves back and forth in a direction orthogonal to a feeding direction of the printing sheet. With serial type ink jet printers, the printing head is moved to a position outside the width of the printing sheet when the flushing action is to be executed, and ink is forcibly discharged from the nozzles towards this position outside the width of the printing sheet.

With line type ink jet printers, the printing head is fixed to a main body of the ink jet printer, and extends along the direction orthogonal to the feeding direction of the printing sheet. When the flushing action is executed with line type ink jet printers, ink may be forcibly discharged from the nozzles into a cavity formed in an outer face of the endless belt. This technique is taught in Japanese Laid-Open Patent Application Publication No. 2004-136664.

In both serial type and line type ink jet printers, maintenance must be performed on the printing head. During maintenance, a flexible blade made from rubber or the like wipes an anterior face (the face in which the nozzles are formed) of the printing head so as to remove foreign matter from the nozzles. At this juncture, ink may be splashed onto the endless belt.

Furthermore, if the printing sheet becomes jammed within the ink jet printer, ink may be discharged onto the endless belt. This may occur in both the serial and line type ink jet printers.

BRIEF SUMMARY OF THE INVENTION

If, for either reason, ink is deposited onto the endless belt, the ink may pass from an edge of the endless belt to its inner face and may then spread, due to the capillary phenomenon, between the endless belt and the rollers, and between the endless belt and the support plate. As a result, ink may spread across the entire inner face of the endless belt, and there may therefore be slippage between the endless belt and the rollers. In that case, there would be a discrepancy between the rotation rate of the rollers and the amount by which the printing sheet is fed and, as a result, the feeding accuracy of the printing sheet would deteriorate. In that case, there would be a distortion of the image that is printed on the printing sheet.

The present invention aims to set forth an ink jet printer capable of preventing deterioration in feeding accuracy of a printing sheet.

An ink jet printer of the present invention comprises: a pair of rollers; an endless belt for feeding a printing sheet, this endless belt being wound around the pair of rollers; and a support plate for supporting an inner face of the endless belt from below between the pair of the rollers. At least one pair of first grooves is formed in an outer peripheral face of each of the rollers. Each of these first grooves is ring shaped and loops around a rotational axis of the roller. At least one pair of second grooves is formed in an upper face of the support plate, each of the second grooves extending along an entire length of the support plate in a feeding direction of the printing sheet.

By providing the above configuration, it is possible to prevent ink—this ink having entered from edges of the endless belt to spread between the endless belt and the rollers, or to spread between the endless belt and the support plate—from passing beyond the first grooves and the second grooves. The ink cannot enter the region between the pair of first grooves or the region between the pair of second grooves. It is thus possible to prevent ink from spreading across the entire inner face of the endless belt, and consequently it is possible to prevent slippage between the endless belt and the rollers. As a result, it is possible to prevent deterioration of the feeding accuracy of the printing sheet.

DETAILED DESCRIPTION OF THE INVENTION

Figure 1:
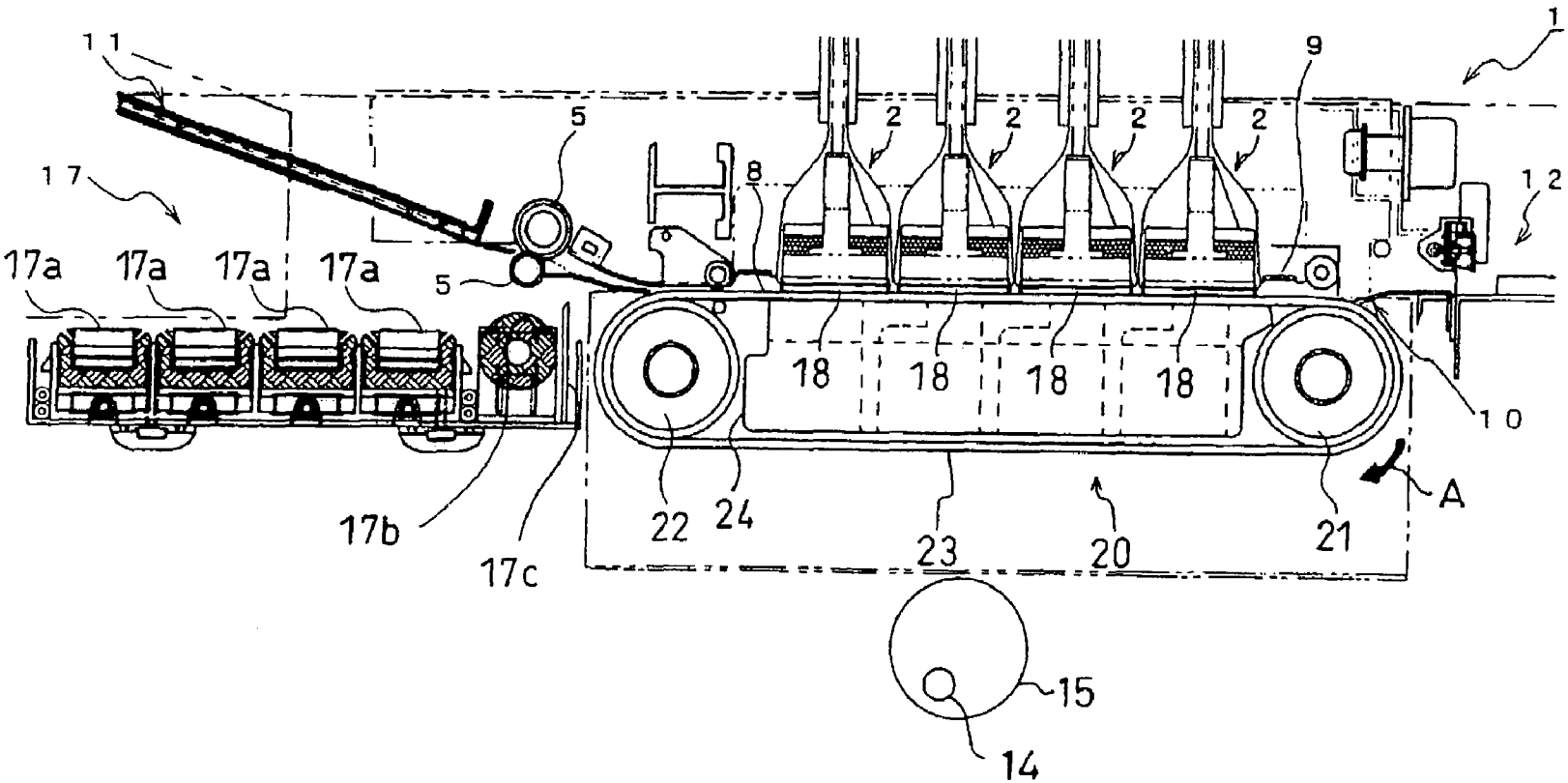
FIG. 1 schematically shows an ink jet printer of a first embodiment.

A preferred embodiment of the present invention will now be described with reference to figures. FIG. 1 schematically shows an ink jet printer of a first embodiment of the present invention. The ink jet printer 1 shown in FIG. 1 is a color ink jet printer provided with four printing heads 2. The ink jet printer 1 is provided with a paper feeding part 11 disposed at the left of the figure, and a paper discharge part 12 disposed at the right of the figure.

A feeding path of the printing sheet is formed within the ink jet printer 1. This feeding path extends from the paper feeding part 11 to the paper discharge part 12. A pair of feeding rollers 5 that grips and feeds the printing sheet is disposed immediately below the paper feeding part 11. The pair of feeding rollers 5 feeds the printing sheet from the left to the right side of the figure.

Belt rotation mechanism 20 is formed at a central part of the feeding path of the printing sheet. The belt rotation mechanism 20 has a pair of rollers 21 and 22; an endless belt 23 wound across the rollers 21 and 22, and a support plate 24 that supports an inner face of the endless belt 23 from below. The support plate 24 is disposed at an inner side of the endless belt 23 and supports, from below, the inner face of an upper half of the endless belt 23 so as to prevent this upper half of the endless belt 23 from bending downwards. An upper face of the support plate 24 is disposed so as to be near the inner face of the upper half of the endless belt 23.

Silicon processing has been performed on an outer face (a feeding face) of the endless belt 23, thereby increasing adhesive force of this outer face. The first roller 21 is driven to rotate in a clockwise direction relative to the figure (in the direction of the arrow A). When the roller 21 rotates, the endless belt 23 is driven thereby to rotate such that its upper half moves towards right side in the figure.

The printing sheet that is delivered onto the endless belt 23 by the pair of feeding rollers 5 adheres to the feeding face of the endless belt 23, and moves together with this endless belt 23. The printing sheet is thus moved towards the right side.

Figure 2:
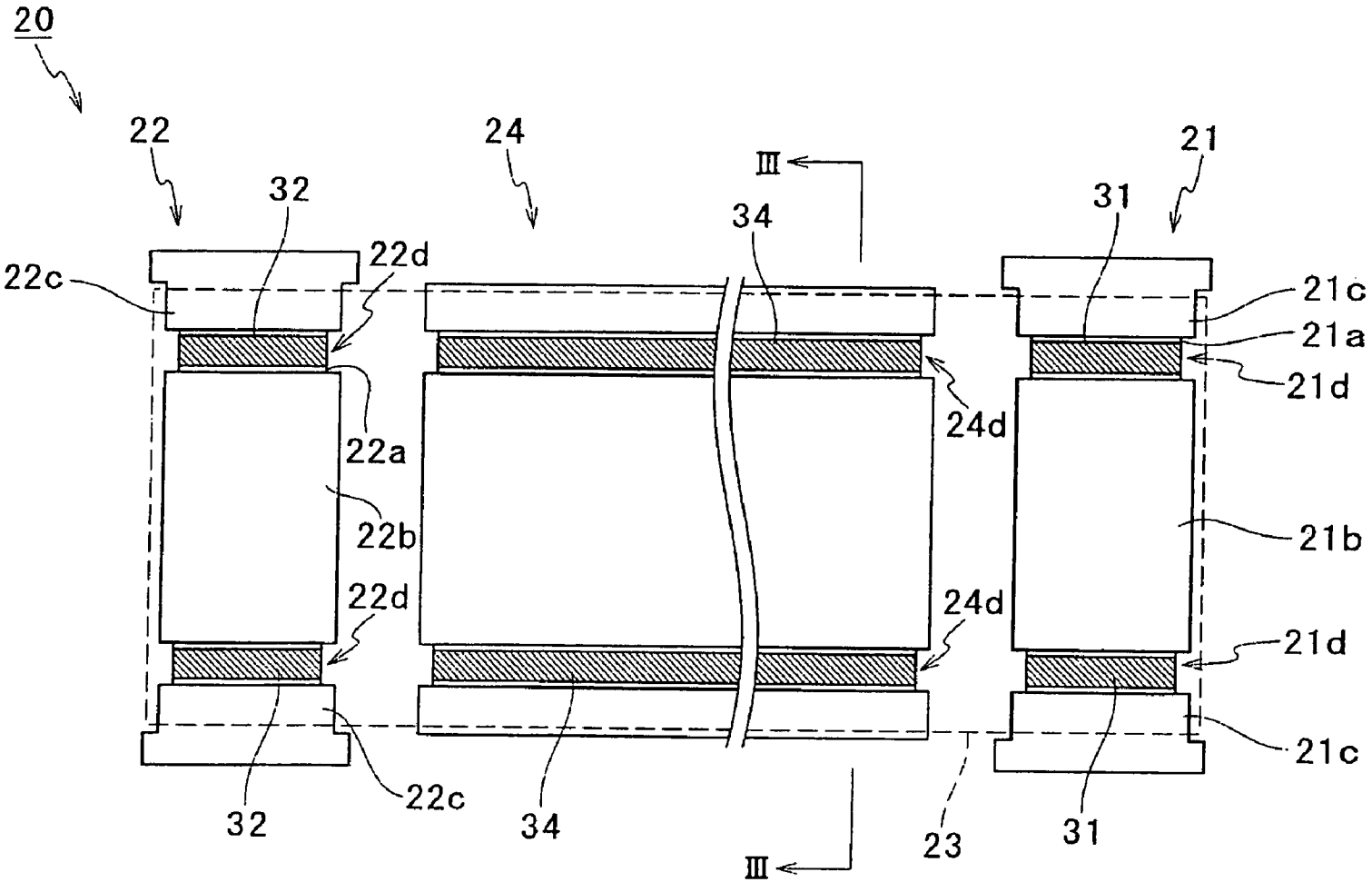
FIG. 2 shows a plane view of a belt rotation mechanism contained in the ink jet printer of FIG. 1.
Figure 3:
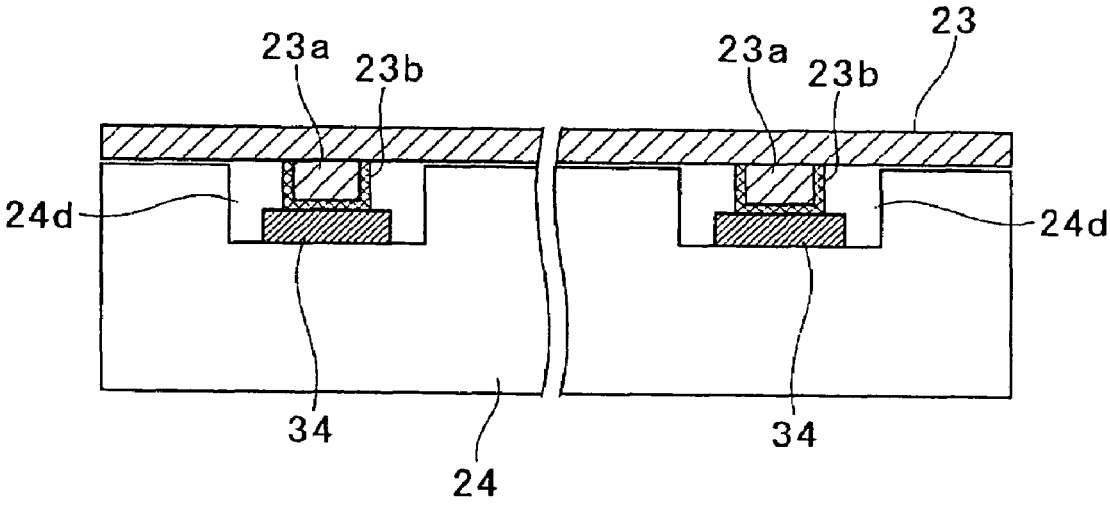
FIG. 3 shows a cross-sectional view along the line III-III of FIG. 2.

The configuration of the belt rotation mechanism 20 will be described in detail with reference to FIGS. 2 and 3. FIG. 2 shows a plane view of the belt rotation mechanism 20. In FIG. 2, only an edge of the endless belt 23 is shown by a dashed line so that the rollers 21 and 22 and the upper face of the support plate 24 can be seen. FIG. 3 shows a cross-sectional view along the line III-III of FIG. 2.

As shown in FIG. 2, the roller 21 is provided with a shaft 21*a*, a drive roller 21*b* that transmits force to the endless belt 23, and a pair of controlling rollers 21*c* that controls the position of the endless belt 23. In FIG. 2, the pair of controlling rollers 21*c* is above and below the endless belt 23, and controls the position in the up-down direction relative to FIG. 2 of the endless belt 23 (the position in the widthwise direction of the endless belt 23).

The drive roller 21*b* and the pair of controlling rollers 21*c* are all fixed to the shaft 21*a*, and the shaft 21*a* is rotated by a driving mechanism (not shown). As a result, the drive roller 21*b* rotates in a unified manner with the shaft 21*a*. The rotation of the drive roller 21*b* causes the endless belt 23 to rotate.

Each of the pair of controlling rollers 21*c* has an identical length in the lengthwise direction of the shaft 21*a* (in the direction orthogonal to the feeding direction). Both controlling rollers 21*c* are disposed such that a predetermined space is formed between each of the controlling rollers 21*c* and each of outer edges, in the lengthwise direction, of the drive roller 21*b*. That is, one first groove 21*d* is formed between the drive roller 21*b* and one of the controlling rollers 21*c*, and another first groove 21*d* is formed between the drive roller 21*b* and the other of the controlling rollers 21*c*. Each of the first grooves 21*d* is ring shaped and makes a loop around the rotational axis of the roller 21. One of the first grooves 21*d* is formed near one edge of the roller 21, and the other of the first grooves 21*d* is formed near the other edge of the roller 21.

Each of the controlling rollers 21*c* is formed of two parts that have differing diameters. An inner part in the lengthwise direction of the shaft 21*a* (i.e. the side facing the drive roller 21*b*) is substantially identical in diameter with the diameter of the drive roller 21*b*. The outer part of the controlling rollers 21*c* is larger in diameter than the diameter of the drive roller 21*b*. This shape allows the pair of controlling rollers 21*c* to control the position of the endless belt 23 in it's widthwise direction.

A first ink absorber 31 made from, for example, felt or the like is disposed within each of the first grooves 21*d*. If ink is present in either of the first grooves 21*d*, this ink is absorbed by the first ink absorber 31. Each of the first ink absorbers 31 is ring shaped. That is, each of the first ink absorbers 31 is disposed around the entire circumference of the first groove 21*d*. As a result, the first ink absorber 31 is capable of absorbing a large amount of ink.

The roller 22 has approximately the same configuration as the roller 21. However, a shaft 22*a* of the roller 22 is not driven by a driving mechanism. Instead, the roller 22 is driven to rotate by the rotation of the endless belt 23. The roller 22 is also provided with a pair of first grooves 22*d*. One of these first grooves 22*d* is formed near one edge of the roller 22, and the other of the first grooves 22*d* is formed near the other edge of the roller 22. A first ink absorber 32 is disposed within each of the first grooves 22*d*. The remaining configuration of the roller 22 is identical with that of the roller 21, and a detailed description thereof is omitted.

A pair of second grooves 24*d* that extends in the feeding direction of the printing sheet is formed in the upper face of the support plate 24. Each of the second grooves 24*d* extends along the entire length of the support plate 24 in the feeding direction of the printing sheet. One of these second grooves 24*d* is formed along one edge of the support plate 24. The other of the second grooves 24*d* is formed along the other edge of the support plate 24.

A second ink absorber 34 made from, for example, felt or the like is disposed within each of the second grooves 24*d*. If ink is present in either of the second grooves 24*d*, this ink is absorbed by the second ink absorber 34. Each of the second ink absorbers 34 is disposed along the entire lengthwise direction of the support plate 24. As a result, the second ink absorber 34 is capable of absorbing a large amount of ink.

As shown in FIG. 2, one of the first grooves 21*d* formed in the roller 21, one of the first grooves 22*d* formed in the roller 22, and one of the second grooves 24*d* formed in the support plate 24 are all disposed along a single straight line. The other of the first grooves 21*d* formed in the roller 21, the other of the first grooves 22*d* formed in the roller 22, and the other of the second grooves 24*d* formed in the support plate 24 are also all disposed along a single straight line.

It is preferred that, regardless of the width of the endless belt 23, the grooves 21*d*, 22*d*, and 24*d* are formed at a position 5~10 mm inwards from both widthwise edges of the endless belt 23.

As shown in FIG. 3, the second ink absorbers 34 are disposed within the second grooves 24*d* such that these second ink absorbers 34 do not make contact with side walls of the second grooves 24*d*. There is a space between an inner side wall (relative to the widthwise direction of the support plate 24) of each of the second ink absorbers 34 and an inner side wall of corresponding second groove 24*d*. There is also a space between an outer side wall of each of the second ink absorbers 34 and an outer side wall of the corresponding second groove 24*d*.

Although this is not shown, the first ink absorbers 31 are also disposed within the first grooves 21*d* such that these first ink absorbers 31 do not make contact with side walls of the first grooves 21*d*. There is a space between an inner side wall (relative to the widthwise direction of the roller 21) of each of the first ink absorbers 31 and an inner side wall of corresponding first groove 21*d*. There is also a space between an outer side wall of each of the first ink absorbers 31 and an outer side wall of the corresponding first groove 21*d*.

The first ink absorbers 32 are also disposed within the first grooves 22*d* such that these first ink absorbers 32 do not make contact with side walls of the first grooves 22*d*. There is a space between an inner side wall (relative to the widthwise direction of the roller 22) of each of the first ink absorbers 32 and an inner side wall of corresponding first grooves 22*d*. There is also a space between an outer side wall of each of the first ink absorbers 32 and an outer side wall of the corresponding first groove 22*d*.

As shown in FIG. 3, a pair of protruding rails 23*a* is formed on the inner face of the endless belt 23. One of the pair of protruding rails 23*a* is disposed in a straight line corresponding to one of the first grooves 21*d* formed in the roller 21, one of the first grooves 22*d* formed in the roller 22, and one of the second grooves 24*d* formed in the support plate 24. The other of the pair of protruding rails 23*a* is disposed in a straight line corresponding to the other of the first grooves 21*d* formed in the roller 21, the other of the first grooves 22*d* formed in the roller 22, and the other of the second grooves 24*d* formed in the support plate 24.

One of the pair of protruding rails 23*a* protrudes into one of the first grooves 21*d*, one of the first grooves 22*d*, and one of the second grooves 24*d*. The other of the pair of protruding rails 23*a* protrudes into the other of the first grooves 21*d*, the other of the first grooves 22*d*, and the other of the second grooves 24*d*.

The protruding rails 23*a* are disposed such that they do not make contact with the side walls of the first grooves 21*d*, the first grooves 22*d*, or the second grooves 24*d*. There is a space between an inner side wall (relative to the widthwise direction of the support plate 24) of each of the protruding rails 23*a* and an inner side wall of corresponding first groove 21*d*, the first groove 22*d*, and the second groove 24*d*. There is also a space between an outer side wall of each of the protruding rails 23*a* and an outer side wall of corresponding first groove 21*d*, the first groove 22*d*, and the second groove 24*d*.

The protruding rails 23*a* do not make contact with the side walls of the grooves 21*d*, 22*d*, or 24*d*. However, a bottom face of each of the protruding rails 23*a* does make contact with the first ink absorbers 31 and 32 and the second ink absorbers 34.

A liquid repelling film 23*b* is formed on surfaces (the bottom face and the side faces) of the protruding rails 23*a* formed on the inner face of the endless belt 23. This liquid repelling film 23*b* repels liquid more powerfully than a face opposite the support plate 24. The liquid repelling ability of the liquid repelling film 23*b* means that ink deposited on the protruding rails 23*a* readily flows off into the grooves 21*d*, 22*d*, and 24*d*.

It is preferred that the liquid repelling film 23*b* has an angle of contact with the ink droplets (i.e. the angle formed between the ink and a surface of the film when this ink is viewed from the side) that is 70° or above. In the case where the angle of contact is close to 180°, the surface of the film repels the ink such that the ink droplets become approximately spherical in shape. Alternatively, in the case where the angle of contact is close to 0°, the ink spreads out across the surface of the film. It can be considered that the greater the angle of contact, the more powerfully the surface of the film repels liquid and that the smaller the angle of contact, the more powerfully the surface of the film attracts liquid.

As shown in FIG. 1, a pressing part 9 is disposed at a side opposite the roller 21, and the feeding path of the printing sheet is located between the pressing part 9 and the roller 21. The purpose of the pressing part 9 is to press the printing sheet onto the feeding face of the endless belt 23 such that this printing sheet does not rise off the feeding face. The printing sheet is thus made to adhere reliably to the feeding face.

A separating mechanism 10 is formed at the right side, relative to the figure, of the endless belt 23. The printing sheet which had been adhering to the feeding face of the endless belt 23 is separated from this feeding face by the separating mechanism 10, and the separating mechanism 10 delivers the printing sheet to the right towards the paper discharge part 12.

A head main body 18 is formed at a lower end of each of the four printing heads 2. Each of the head main bodies 18 is formed by joining together a passage unit and an actuator unit. The passage unit has an ink passage that includes a pressure chamber. The actuator unit applies pressure to the ink within the pressure chamber. Each of the head main bodies 18 has a rectangular section that is located such that its longitudinal direction is perpendicular to the feeding direction of the printing sheet (perpendicular to the plane of the page of FIG. 1). The ink jet printer 1 is a line type printer. Each bottom face of the four head main bodies 18 faces the feeding path of the printing sheet, and a plurality of extremely small ink discharge holes (nozzles) are formed in these bottom faces. The four head main bodies 18 respectively discharge magenta, yellow, cyan and black ink.

The head main bodies 18 are disposed such that a small space is formed between their lower faces and the feeding face of the endless belt 23. The feeding path of the printing sheet is maintained within this space. When the printing sheet that is delivered by the endless belt 23 passes in turn directly below the four head main bodies 18, ink of each color is discharged from the nozzles onto an upper face (a printing face) of the printing sheet, thereby allowing a desired color image to be printed onto the printing sheet.

The ink jet printer 1 is provided with a maintenance unit 17 that allows maintenance to be performed automatically on the printing head 2. The maintenance unit 17 is provided with a cap 17*a*, a wiping roller 17*b*, a blade 17*c*, etc.

The cap 17*a* covers the base face of the four head main bodies 18, and prevents the nozzles from drying out. Further, the cap 17*a* is connected with a suction pump or the like that can extract ink mixed with dust or air bubbles, ink that has dried and become viscous, etc. from the nozzles during maintenance.

During maintenance, the wiping roller 17*b* and the blade 17*c* clean away ink that has been deposited on the bottom faces of the head main bodies 18. More specifically, the wiping roller 17*b* is a roller that consists of a porous material such as polyurethane or the like, and that is capable of absorbing ink that has been deposited on the bottom face of the head main bodies 18. The blade 17*c* consists of a flexible material such as rubber or the like, and is capable of wiping away ink that has been deposited on the bottom face of the head main bodies 18 without damaging these head main bodies 18.

The maintenance unit 17 is located directly below the paper feeding part 11 (in a retreated position) while the ink jet printer 1 is performing printing. When printing has been completed and predetermined conditions have been fulfilled (for example, a predetermined period of time has elapsed in which printing has not been performed, or a power source of the ink jet printer 1 has been turned OFF), the maintenance unit 17 moves to a position directly below the four head main bodies 18 (to a capping position).

The belt rotation mechanism 20 is supported by a raising and lowering mechanism that comprises a rotary shaft 14 and an eccentric cam 15 that rotates together with the rotation of the rotary shaft 14. When the maintenance unit 17 is moved between the retreated position and the capping position, the raising and lowering mechanism lowers the belt rotation mechanism 20 by a requisite distance from the position shown in FIG. 1. The raising and lowering mechanism thus ensures that the maintenance unit 17 has space to move.

With the belt rotation mechanism 20 in the ink jet printer 1 of the present embodiment, the ring shaped first grooves 21*d* and 22*d*—these making a loop around the rotational axis—are each formed as two grooves in the rollers 21 and 22 respectively. The two second grooves 24*d*, these extending in the feeding direction, are formed along the entire upper face of the support plate 24. As a result, ink that has entered from the side edges of the endless belt 23 and would enter between the endless belt 23 and the rollers 21 and 22, and between the endless belt 23 and the support plate 24, will not pass beyond the grooves 21*d*, 22*d*, and 24*d*. Ink will not enter the area between the pair of first grooves 21*d* and 22*d*, or the area between the pair of second grooves 24*d*. As a result, it is possible to prevent the phenomenon in which ink is deposited on the entire inner face of the endless belt 23 and causes slippage between the endless belt 23 and the rollers 21 and 22. It is therefore possible to prevent deterioration in the feeding accuracy of the printing sheet over a long period.

In the belt rotation mechanism 20 of the present embodiment, one of the first grooves 21*d* formed in the roller 21 is formed near one edge of the roller 21, and the other of the first grooves 21*d* formed in the roller 21 is formed near the other edge of the roller 21. A wide area is maintained between the pair of first grooves 21*d*. Similarly, one of the first grooves 22*d* formed in the roller 22 is formed near one edge of the roller 22, and the other of the first grooves 22*d* formed in the roller 22 is formed near the other edge of the roller 22. A wide area is maintained between the pair of first grooves 22*d*. Furthermore, one of the second grooves 24*d* formed in the support plate 24 is formed near one edge of the support plate 24, and the other of the second grooves 24*d* formed in the support plate 24 is formed near the other edge of the support plate 24. A wide area is maintained between the pair of second grooves 24*d*. It is thus possible to maintain a wide area in which ink is not deposited at the inner side, relative to the widthwise direction, of the rollers 21 and 22 and the support plate 24. Slippage between the endless belt 23 and the rollers 21 and 22 can thus be prevented effectively.

With the belt rotation mechanism 20 of the present embodiment, the first grooves 21*d* formed in the roller 21, the first grooves 22*d* formed in the roller 22, and the second grooves 24*d* formed in the support plate 24 are all formed in a straight line, and the protruding rails 23*a* are formed on the inner face of the endless belt 23 in positions corresponding to these grooves. Even if ink were to enter the inner face of the endless belt 23 from either side edge, in the widthwise direction, of the endless belt 23, the protruding rails 23*a* will cause the ink to flow in the direction of gravity. The ink can thus be prevented from entering the area between the pair of protruding rails 23*a*.

In the belt rotation mechanism 20 of the present embodiment, the protruding rails 23*a* are formed such that they do not make contact with the side walls of the grooves 21*d*, 22*d*, or 24*d*. As a result, it is possible to prevent ink from passing beyond the protruding rails 23*a* and spreading to the area between these protruding rails 23*a*.

With the belt rotation mechanism 20 of the present embodiment, the first ink absorbers 31 and 32 are fixed such that they do not make contact with either of the side walls of the first grooves 21*d* and 22*d*, and the second ink absorbers 34 are fixed such that they do not make contact with either of the side walls of the second grooves 24*d*. As a result, the ink that has been absorbed into the first ink absorbers 31 and 32 and the second ink absorbers 34 is not transmitted to the inner side walls (relative to the widthwise direction) of the grooves 21*d*, 22*d*, and 24*d*, and does not enter the area between the protruding rails 23*a*. Ink can thus be prevented from entering between the endless belt 23 and the rollers 21 and 22, and between the endless belt 23 and the support plate 24, all of which are located in the area between the protruding rails 23*a*. Furthermore, the ink that has been absorbed into the first ink absorbers 31 and 32 and the second ink absorbers 34 is not transmitted to the outer side walls (relative to the widthwise direction) of the grooves 21*d*, 22*d*, and 24*d*. Therefore the ink can be prevented from flowing back into the area between the endless belt 23 and the rollers 21 and 22, and between the endless belt 23 and the support plate 24, all of which is located out side of protruding rails 23*a*.

With the belt rotation mechanism 20 of the present embodiment, the tips of the protruding rails 23*a* are formed so as to make contact with the first ink absorbers 31 and 32 and the second ink absorbers 34. As a result, ink that has adhered to the protruding rails 23*a* does not pass beyond these protruding rails 23*a*, but instead is absorbed by the ink absorbers 31, 32, and 34. Therefore, ink does not pass over the protruding rails 23*a* and enter the area therebetween. Ink can thus reliably be prevented from entering between the endless belt 23 and the rollers 21 and 22, and between the endless belt 23 and the support plate 24, all of which are located in the area between the protruding rails 23*a*.

Figure 4:
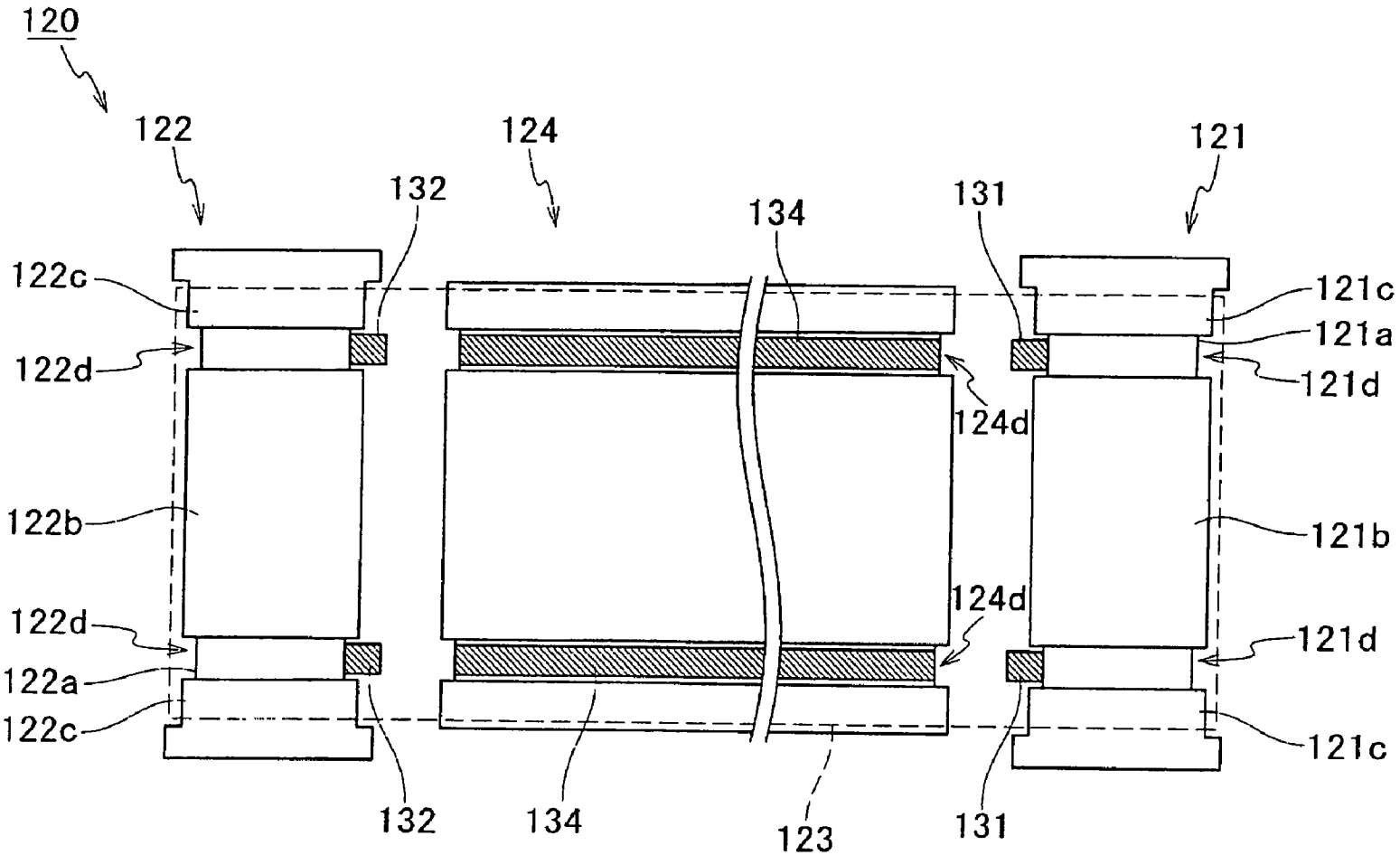
FIG. 4 shows a plane view of a belt rotation mechanism contained in an ink jet printer of a second embodiment.

Next, a second example of the present invention will be described with reference to FIG. 4. FIG. 4 shows a plane view of a belt rotation mechanism provided in an ink jet printer of a second embodiment of the present invention. Here, only an edge of an endless belt is shown by a dashed line so that rollers and an upper face of a support plate can be seen.

In the ink jet printer of the second embodiment, first ink absorbers 131 and 132 are disposed at the exterior of two first grooves 121*d* of a drive roller 121 and two first grooves 122*d* of a driven roller 122 respectively. These first ink absorbers 131 and 132 absorb ink that is present in the first grooves 121*d* and 122*d*. The remaining configuration is approximately identical with that of the first configuration shown in FIG. 2, and a detailed description thereof is omitted. Parts having the two lower digits the same as in the first embodiment are parts identical with the first embodiment. This numbering convention is also true for first and second variants (to be described).

The first ink absorbers 131 and 132 are disposed such that they do not make contact with both side walls of the first grooves 121*d* and 122*d*. Second ink absorbers 134 are disposed within second grooves 124*d*. These second ink absorbers 134 are disposed such that they do not make contact with either side wall of the second grooves 124*d*.

Although this is not shown, protruding rails are formed on an inner face of an endless belt 123 in a position corresponding to the grooves 121*d*, 122*d*, and 124*d*. The protruding rails do not make contact with any of the side walls of the grooves 121*d*, 122*d*, and 124*d*.

With a belt rotation mechanism 120 of the present embodiment, as well, ink can be prevented from entering between the endless belt 123 and the rollers 121 and 122, and between the endless belt 123 and a support plate 124, all of which are located in the area between the protruding rails. As with the first embodiment, it is possible to prevent the feeding accuracy of the printing sheet from deteriorating.

With the belt rotation mechanism 120 of the present embodiment, the first ink absorbers 131 and 132 are fixed at the exterior of the first grooves 121*d* and 122*d*. As a result, the first ink absorbers 131 and 132 do not move as the rollers 121 and 122 rotate. Consequently, it is possible to prevent the ink that has flowed into the first grooves 121*d* and 122*d* and has been absorbed by the first ink absorbers 131 and 132 from being scattered by the centrifugal force caused by the rotation of the rollers 121 and 122. The ink can thus reliably be prevented from entering between the endless belt 123 and the rollers 121 and 122.

Embodiments suitable for realizing the present invention have been described above. However, the present invention is not limited to the embodiments described above. The art set forth in the claims encompasses various modifications to the embodiments described above.

Figure 5:
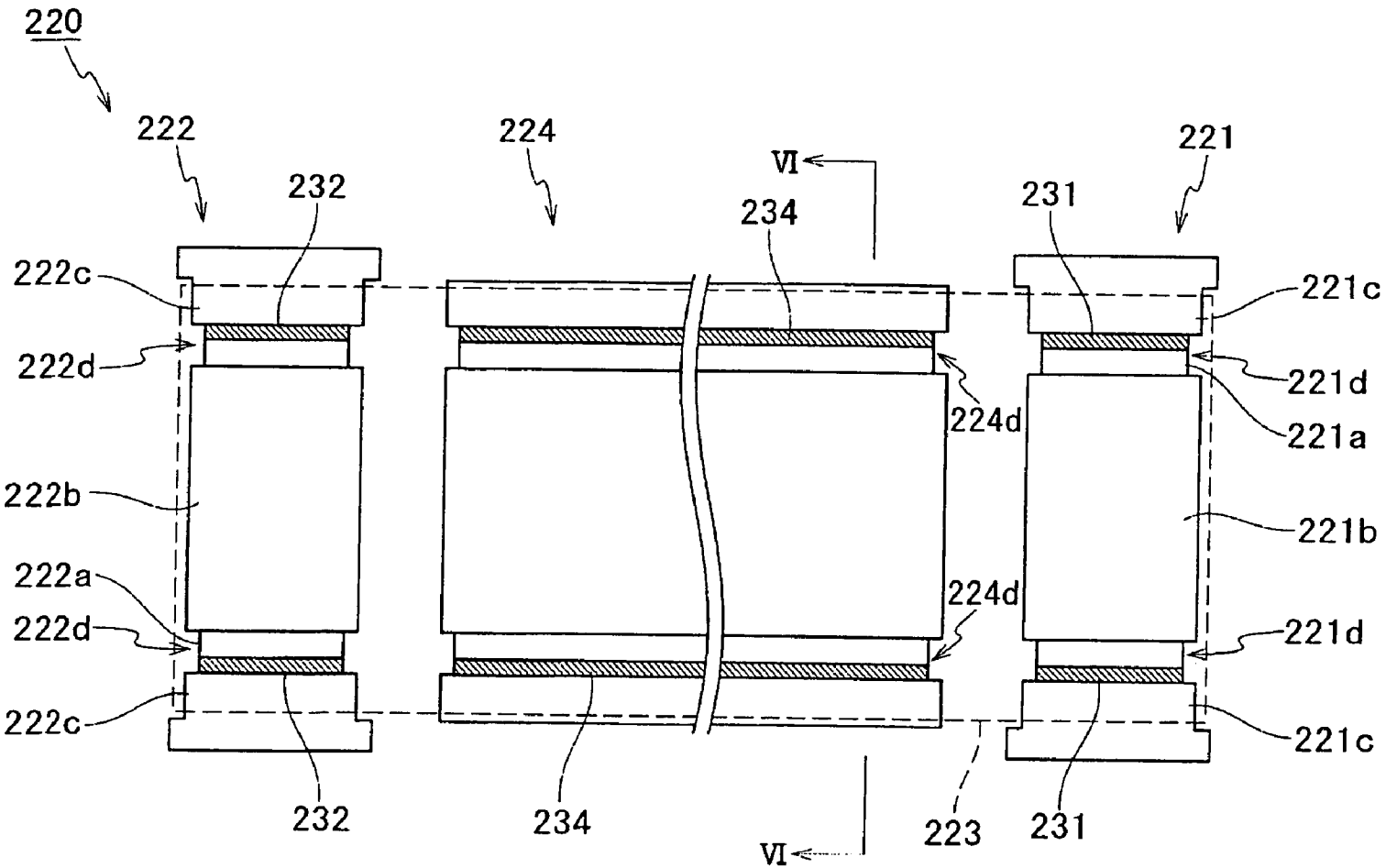
FIG. 5 shows a plane view of a first variant of the belt rotation mechanism shown in FIG. 2.
Figure 6:
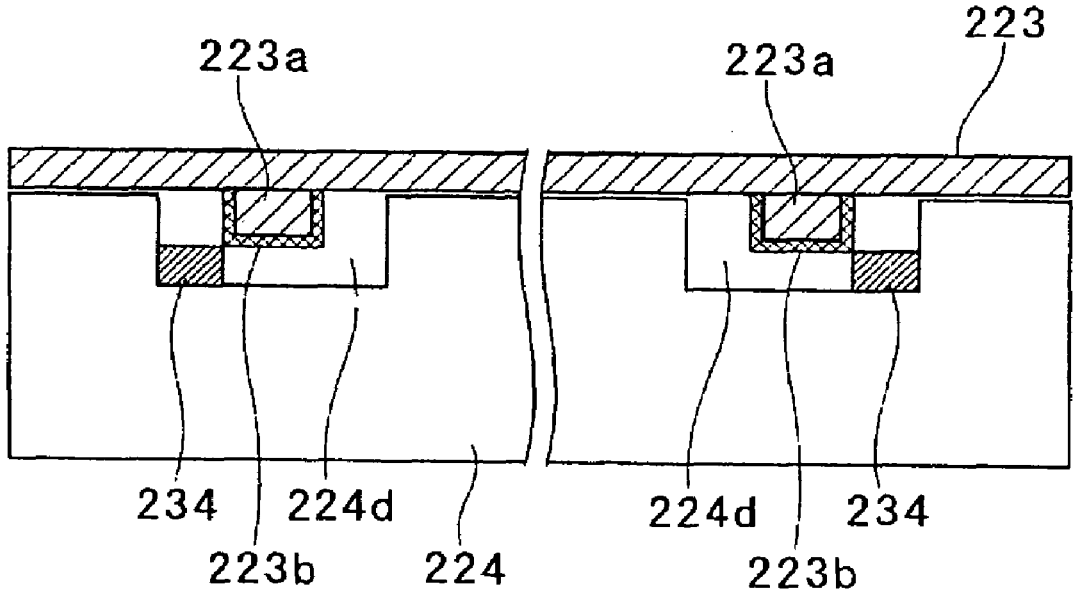
FIG. 6 shows a cross-sectional view along the line VI-VI of FIG. 5.

For example, a first variant of the first embodiment is shown in FIGS. 5 and 6. FIG. 5 shows a plane view of a belt rotation mechanism of an ink jet printer of a first variant. Here, only an edge of an endless belt is shown by a dashed line so that rollers and an upper face of a support plate can be seen. FIG. 6 shows a cross-sectional view along the line VI-VI of FIG. 5.

As shown in FIGS. 5 and 6, each first ink absorber 231 makes contact with an outer side wall of corresponding first groove 221*d*, and each first ink absorber 232 makes contact with an outer side wall of corresponding first groove 222*d*. Each second ink absorber 234 makes contact with an outer side wall of corresponding second groove 224*d*.

As shown in FIG. 6, an inner side face of each second ink absorber 234—this being the side face that does not make contact with the outer side wall of the corresponding second grooves 224*d*—makes contact with each protruding rails 223*a* that are formed on an endless belt 223. Although this is not shown, a side face of each of the first ink absorbers 231 and 232—this being the side face that does not make contact with the outer side wall of the corresponding first grooves 221*d* and 222*d*—makes contact with each protruding rails 223*a*.

With the aforementioned configuration, a belt rotation mechanism 220 of the present variant prevents ink that has flowed into the second grooves 224*d* from being transmitted to the inner side walls of the second grooves 224*d*, and therefore the ink does not enter the region between the pair of second grooves 224*d*. The ink can thus be prevented from entering between the endless belt 223 and a support plate 224, which are located in the region between the pair of second grooves 224*d*. Further, ink that has flowed into the first grooves is not transmitted to the inner side walls of these first grooves 221*d* and 222*d*, and thus the ink does not enter the region between the pair of first grooves 221*d* and 222*d*. The ink can thus be prevented from entering between the endless belt 223 and rollers 221 and 222, which are located in the region between the first grooves 221*d* and 222*d*.

In the first variant, a case was described in which the first ink absorbers 231 and 232 are fixed within the first grooves 221*d* and 222*d*, as shown in FIG. 5. However, the variant is not limited to this example. For example, the first ink absorbers 231 and 232 may equally well be fixed at the exterior of the first grooves 221*d* and 222*d*.

Figure 7:
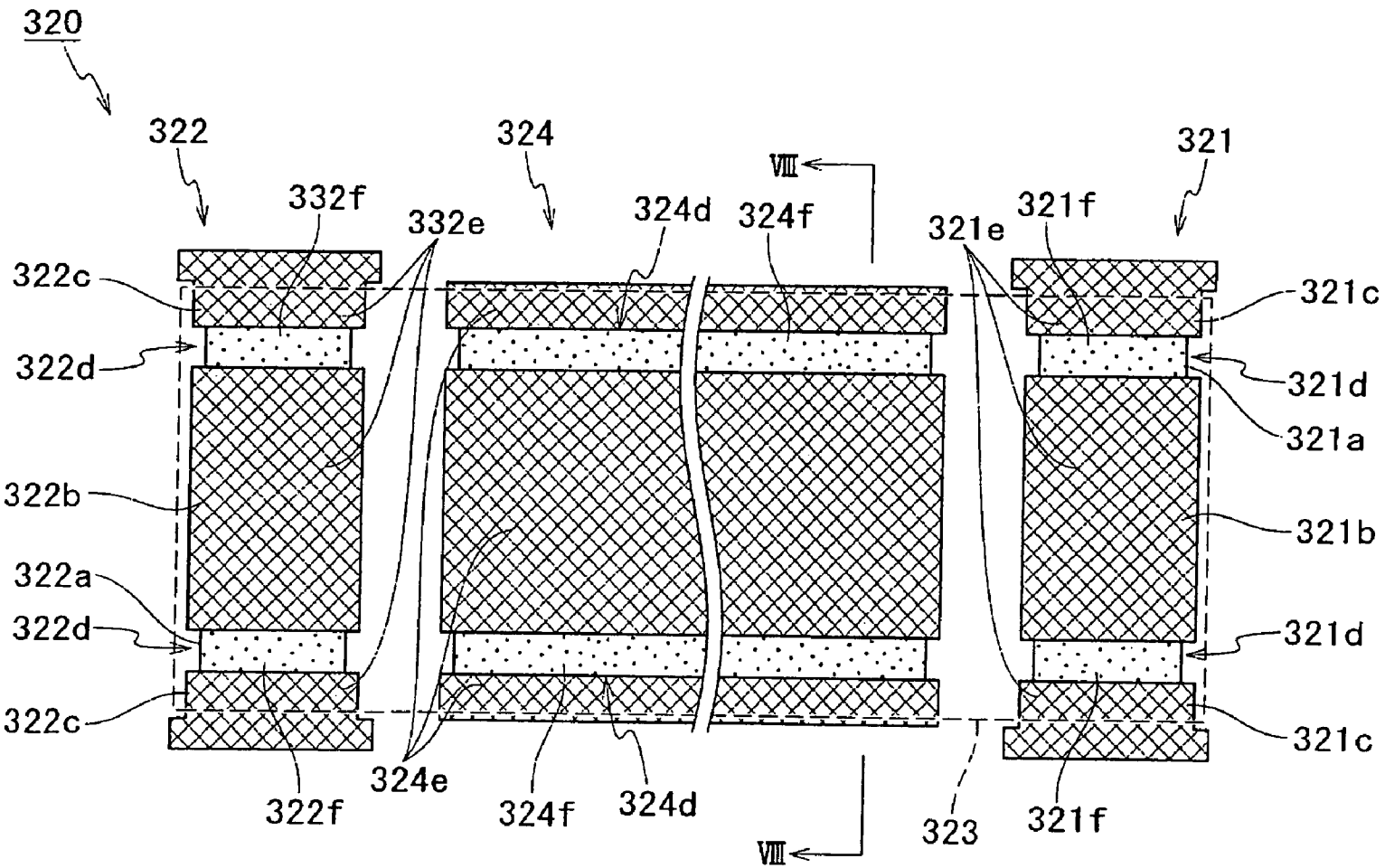
FIG. 7 shows a plane view of a second variant of the belt rotation mechanism shown in FIG. 2.
Figure 8:
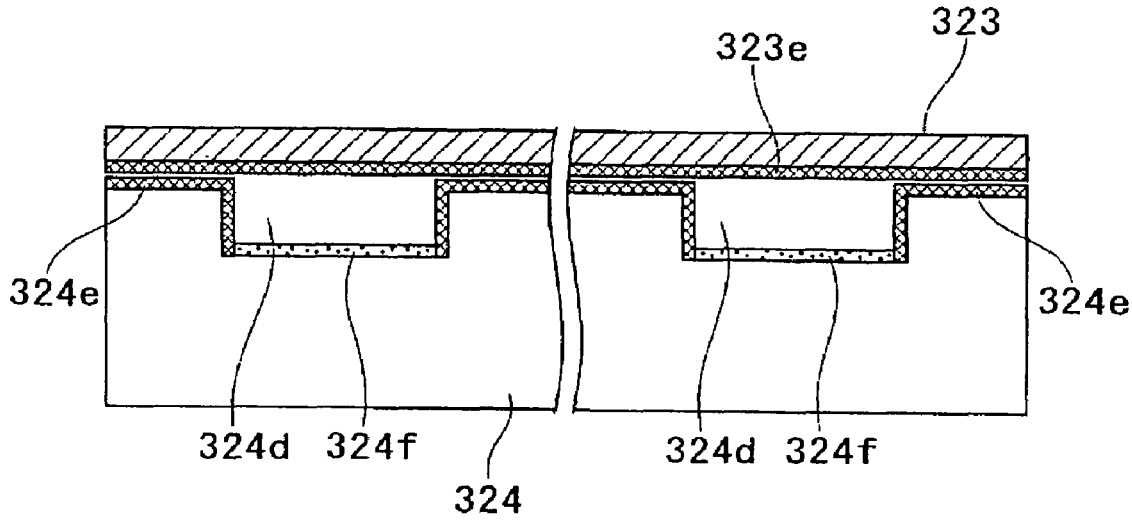
FIG. 8 shows a cross-sectional view along the line VIII-VIII of FIG. 7.

Next, a second variant of the first embodiment is shown in FIGS. 7 and 8. FIG. 7 shows a plane view of a belt rotation mechanism of an ink jet printer of the present variant. Here, only an edge of an endless belt is shown by a dashed line so that rollers and an upper face of a support plate can be seen. FIG. 8 shows a cross-sectional view along the line VIII-VIII of FIG. 7.

As shown in FIGS. 7 and 8, a liquid repelling film 324*e* capable of powerfully repelling liquid is formed on a face (an upper face) of a support plate 324 opposite an endless belt 323, and on both side walls of each of second grooves 324*d*. Similarly, liquid repelling films 321*e* and 322*e* capable of powerfully repelling liquid are formed on outer peripheral faces of rollers 321 and 322 respectively, and on both side walls of each of first grooves 321*d* and 322*d*. Moreover, as shown in FIG. 8, a liquid repelling film 323*e* capable of powerfully repelling liquid is formed on an inner face of the endless belt 323.

Further, as shown in FIGS. 7 and 8, a liquid attracting film 324*f* capable of powerfully attracting liquid is formed at a base face of each of the second grooves 324*d* of the support plate 324. Moreover, as shown in FIG. 7, liquid attracting films 321*f* and 322*f* capable of powerfully attracting liquid are formed at a base face of each of the first grooves 321*d* and 322*d* of the rollers 321 and 322 respectively.

It is preferred that the angle of contact with the liquid repelling films 324*e*, 321*e*, 322*e*, and 323*e* is 70° or above. Furthermore, it is preferred that the angle of contact with the liquid attracting films 324*f*, 321*f*, and 322*f* is 30° or below.

In the present variant, the face of the support plate 324 opposite the endless belt 323, the side walls of the second grooves 324*d*, the outer peripheral faces of the rollers 321 and 322, the side walls of the first grooves 321*d* and 322*d*, and the inner face of the endless belt 323 are all more liquid repellent than the base faces of the grooves 321*d*, 322*d*, and 324*d*.

By adopting the above configuration, ink that has flowed into the grooves 321*d*, 322*d*, and 324*d* is effectively prevented from being transmitted to the inner side walls of these grooves 321*d*, 322*d*, and 324*d* by the liquid repelling function of the liquid repelling films 321*e*, 322*e*, and 323*e* formed on the rollers 321, 322, and the support plate 324, as well as by the liquid attracting function of the liquid attracting films 321*f*, 322*f*, and 324*f*. The ink is thus effectively prevented from entering between the endless belt 323 and the rollers 321 and 322, and between the endless belt 323 and the support plate 324. Should ink enter therein, it is also difficult for the ink to spread between the endless belt 323 and the support plate 324, and between the endless belt 323 and the rollers 321 and 322.

In the second variant, ink absorbers are not disposed within the grooves 321*d*, 322*d*, and 324*d*, as shown in FIGS. 7 and 8. However, ink absorbers can equally well be disposed therein. Furthermore, protruding rails are not formed on the inner face of the endless belt 323 in the second variant. However, protruding rails can equally well be provided.

In the second variant, a case has been described in which the liquid repelling films 321*e*, 322*e*, 324*e*, and 323*e* are formed on the outer peripheral faces of the rollers 321, 322, on the side walls of the first grooves 321*d* and 322*d*, on the upper face of the support plate 324, on the side walls of the second grooves 324*d*, and on the inner face of the endless belt 323. Further, the liquid attracting films 321*f*, 322*f*, and 324*f* are formed on the base faces of the grooves 321*d*, 322*d*, and 324*d*. However, the configuration is not restricted to this example. It is equally possible that the inner side walls of the first grooves 321*d* and 322*d* have a greater liquid repelling ability than the base faces of the first grooves 321*d* and 322*d*, and that the inner side walls of the second grooves 324*d* have a greater liquid repelling ability than the base faces of the second grooves 324*d*. It is consequently equally possible, for example, that only the inner side walls of the grooves 321*d*, 322*d*, and 324*d* have the liquid repelling film, and that only the base faces of the grooves 321*d*, 322*d*, and 324*d* have the liquid attracting film.

In the first embodiment and in its variant, the first ink absorbers are disposed within the first grooves along the entire length of their circumference direction. However, the configuration is not restricted to this example. It is equally possible to dispose a plurality of first ink absorbers at intervals within the first grooves. Similarly, a plurality of second ink absorbers may be disposed at intervals within the second grooves.

The protruding rails and the ink absorbers within the grooves may equally well be formed only on one of either of the sides. A case is equally possible in which the protruding rails are provided whereas the first ink absorbers and the second ink absorbers are not provided. Alternatively, a case is equally possible in which the first ink absorbers and the second ink absorbers are provided whereas the protruding rails are not provided. In the case where the protruding rails are not provided, the first ink absorbers and the second ink absorbers do not need to be disposed in a single straight line.

In the aforementioned embodiments, the case was described in which the liquid repelling films are formed on the surface faces of the protruding rails. However, the liquid repelling films may equally well not be formed thereon.

In the aforementioned embodiments, the first ink absorbers and the second ink absorbers make contact with the protruding rails. However, the first ink absorbers and the second ink absorbers may equally well not make contact with the protruding rails.

In the aforementioned embodiments, the case was described in which each of the rollers comprises a shaft, a drive roller, and a pair of controlling rollers, and in which the spaces between the drive roller and the controlling rollers form the first grooves. However, the configuration is not restricted to this example. It is equally possible, for example, that the drive roller and the controlling rollers make contact, and that the first grooves are formed in an outer peripheral face of the drive roller by means of a cutting process or the like. Further, it is equally possible that the rollers consist of one member, and that the first grooves are formed in an outer peripheral face thereof.

In the first embodiment, the second embodiment, and the first variant, the case was described in which the surface face of the protruding rails of the endless belt has been given a powerful liquid repelling ability by providing the liquid repelling film. Further, in the second variant, the case was described in which the outer peripheral face of the rollers, both side walls of the first grooves, the upper face of the support plate, both side walls of the second grooves, and the inner face of the endless belt have been given a powerful liquid repelling ability by providing the liquid repelling film thereon. Further, the base faces of the grooves have been given a powerful liquid attracting ability by providing the liquid attracting film thereon. However, the method is not restricted to providing these liquid repelling and liquid attracting abilities. For example, using the fact that liquid repulsion increases as a surface grows finer and that liquid attraction increases as a surface grows coarser, the liquid repelling and liquid attracting abilities may equally well be provided by adjusting the coarseness of the surfaces.

What is claimed is:

1. An ink jet printer comprising:

a pair of rollers;

an endless belt for feeding a printing sheet, this endless belt being wound around the pair of rollers; and a support plate for supporting an inner face of the endless belt between the pair of rollers, wherein at least one pair of first grooves is formed in an outer peripheral face of each of the rollers, each of the first grooves being ring shaped and looping around a rotational axis of the roller, and at least one pair of second grooves is formed in an upper face of the support plate, each of the second grooves extending along an entire length of the support plate in a feeding direction of the printing sheet;

the ink jet further comprising first ink absorbers for absorbing ink within the first grooves.

2. An ink jet printer of claim 1 wherein:

one of the pair of first grooves is formed near one edge of the rollers;

the other of the pair of first grooves is formed near the other edge of the rollers;

one of the pair of second grooves is formed along one edge of the support plate; and the other of the pair of second grooves is formed along the other edge of the support plate.

3. An ink jet printer of claim 2 wherein:

one of the first grooves and one of the second grooves are disposed along a single straight line; and the other of the first grooves and the other of the second grooves are disposed along a single straight line.

4. An ink jet printer of claim 3 wherein:

a pair of protruding rails extending in the feeding direction of the printing sheet is formed on the inner face of the endless belt, these protruding rails protruding into the first grooves and the second grooves disposed along the single straight line.

5. An ink jet printer of claim 4 wherein:

spaces are present at both sides of the protruding rails, these spaces being between side walls of the protruding rails and side walls of the first grooves; and spaces are present at both sides of the protruding rails, these spaces being between side walls of the protruding rails and side walls of the second grooves.

6. An ink jet printer of claim 1 wherein:

the first ink absorbers are housed within the first grooves.

7. An ink jet printer of claim 6 wherein:

a space is present between a side wall of each of the first ink absorbers and a side wall of corresponding one of the first grooves, the latter side wall being an inner side wall relative to a widthwise direction of the rollers.

8. An ink jet printer of claim 7 wherein:

a space is present between a side wall of each of the first ink absorbers and a side walls of corresponding one of the first grooves, the latter side wall being an outer side wall relative to a widthwise direction of the rollers.

9. An inkjet printer of claim 6 wherein:

the protruding rails formed on the inner face of the endless belt make contact with the first ink absorbers.

10. An ink jet printer of claim 1 wherein:

the first ink absorbers are disposed at the exterior of the first grooves.

11. An ink jet printer of claim 1 further having:

second ink absorbers for absorbing ink within the second grooves.

12. An ink jet printer of claim 11 wherein:

the second ink absorbers are housed within the second grooves.

13. An ink jet printer of claim 12 wherein:

a space is present between a side wall of each of the second ink absorbers and a side wall of corresponding one of the second grooves, the latter side wall being an inner side wall relative to a widthwise direction of the support plate.

14. An ink jet printer of claim 13 wherein:

a space is present between a side wall of each of the second ink absorbers and a side wall of corresponding one of the second grooves, the latter side wall being an outer side wall relative to a widthwise direction of the support plate.

15. An ink jet printer of claim 12 wherein:

protruding rails formed on the inner face of the endless belt make contact with the second ink absorbers.

16. An ink jet printer of claim 1 wherein:

side walls of the first grooves, these side walls being inner side walls relative to a widthwise direction of the rollers, have a greater liquid repelling effect than base faces of the first grooves.

17. An ink jet printer of claim 1 wherein:

side walls of the second grooves, these side walls being inner side walls relative to a widthwise direction of the support plate, have a greater liquid repelling effect than base faces of the second grooves.

18. An ink jet printer of claim 1 wherein:

a liquid repelling process is performed on a face of the support plate, this face supporting the endless belt.

19. An ink jet printer of claim 1 wherein:

a liquid repelling process is performed on the inner face of the endless belt.

20. An ink jet printer comprising:

a pair of rollers;

an endless belt for feeding a printing sheet, this endless belt being wound around the pair of rollers; and a support plate for supporting an inner face of the endless belt between the pair of rollers;

wherein at least one pair of first grooves is formed in an outer peripheral face of each of the rollers, each of the first grooves being ring shaped and looping around a rotational axis of the roller; and at least one pair of second grooves is formed in an upper face of the support plate, each of the second grooves extending along an entire length of the support plate in a feeding direction of the printing sheet;

the ink jet further comprising second ink absorbers for absorbing ink within the second grooves, the second ink absorbers being housed within the second grooves.

* * * * *